US006422186B1

(12) United States Patent
Vanderpoel

(10) Patent No.: US 6,422,186 B1
(45) Date of Patent: Jul. 23, 2002

(54) LOST MOTION ROCKER ARM SYSTEM WITH INTEGRATED COMPRESSION BRAKE

(75) Inventor: Richard Vanderpoel, Bloomfield, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/657,534

(22) Filed: Sep. 8, 2000

Related U.S. Application Data

(60) Provisional application No. 60/154,014, filed on Sep. 15, 1999, and provisional application No. 60/153,079, filed on Sep. 10, 1999.

(51) Int. Cl.[7] ..... F01L 1/34

(52) U.S. Cl. ..... 123/90.15; 123/90.16; 123/90.43; 123/90.46; 123/90.55

(58) Field of Search ..... 123/90.15, 90.12, 123/90.16, 90.35, 90.36, 90.43, 90.44, 90.46, 90.55, 321, 322

(56) References Cited

U.S. PATENT DOCUMENTS

| | | | | | |
|---|---|---|---|---|---|
| 3,220,392 | A | | 11/1965 | Cummins | |
| 3,786,792 | A | | 1/1974 | Pelizzoni et al. | |
| 3,809,033 | A | | 5/1974 | Cartledge | |
| 4,220,122 | A | * | 9/1980 | Aoyama | 123/90.55 |
| 4,387,680 | A | * | 6/1983 | Tsunetomi et al. | 123/90.15 |
| 5,025,761 | A | * | 6/1991 | Chen | 123/90.16 |
| 5,146,890 | A | | 9/1992 | Gobert et al. | |
| 5,186,130 | A | * | 2/1993 | Melchior | 123/90.35 |
| 5,282,443 | A | * | 2/1994 | Fujiyoshi et al. | 123/90.16 |
| 5,495,838 | A | | 3/1996 | Johnson, Jr. | |
| 5,507,261 | A | | 4/1996 | Johnson, Jr. | |
| 5,564,385 | A | | 10/1996 | Hakansson | |
| 5,586,531 | A | | 12/1996 | Vittorio | |
| 5,606,960 | A | * | 3/1997 | Takahashi et al. | 123/90.15 |
| 5,609,133 | A | | 3/1997 | Hakansson | |
| 5,626,116 | A | | 5/1997 | Reedy et al. | |
| 5,680,841 | A | | 10/1997 | Hu | |
| 5,857,438 | A | * | 1/1999 | Barnard | 123/90.16 |
| 5,890,469 | A | | 4/1999 | Hakansson et al. | |
| 5,960,754 | A | * | 10/1999 | Sugimoto et al. | 123/90.15 |
| 5,975,251 | A | | 11/1999 | McCarthy | |
| 6,000,374 | A | | 12/1999 | Cosma et al. | |
| 6,244,257 | B1 | * | 6/2001 | Hu | 123/90.46 |
| 6,253,730 | B1 | * | 7/2001 | Gustafson | 123/321 |
| 6,257,183 | B1 | * | 7/2001 | Vorih et al. | 123/90.12 |

* cited by examiner

*Primary Examiner*—Teresa Walberg
*Assistant Examiner*—Fadi H. Dahbour
(74) *Attorney, Agent, or Firm*—David R. Yohannan; Collier Shannon Scott, PLLC

(57) ABSTRACT

The present invention is directed to a system for operating at least one exhaust valve of an engine. The engine has at least two engine operating conditions. The system in accordance with the present invention includes an energy supply assembly for supplying energy to operate the at least one exhaust valve during one of the at least two engine operating conditions. The system may further include an energy transfer assembly for transferring the energy from the energy supply assembly to operate the at least one exhaust valve. A valve actuating assembly is also included for actuating the at least one exhaust valve in response to operation of the energy transfer assembly. During operation, the energy transfer assembly transfers a first amount of energy to the valve actuating assembly during a first engine operating condition to open the at least one valve a first predetermined distance, and the energy transfer assembly transfers a second amount of energy to the valve actuating assembly during a second engine operating condition to open the at least one valve a second predetermined distance.

45 Claims, 8 Drawing Sheets

LOST MOTION ROCKER ARM SYSTEM WITH INTEGRATED COMPRESSION BRAKE

CROSS REFERENCE TO RELATED APPLICATIONS

The present U.S. utility patent application relates to and draws priority on U.S. provisional patent application serial number 60/153,079 filed Sep. 10, 1999, and U.S. provisional patent application Ser. No. 60/154,014 filed Sep. 15, 1999.

FIELD OF THE INVENTION

The present invention relates generally to a rocker arm system for controlling exhaust valves during positive power and engine braking. In particular, the present invention is directed to a rocker arm system having a lost motion piston for modifying a valve motion profile of the exhaust valve during positive power and different operating conditions. The present invention is also directed to a valve actuation mechanism that automatically adjusts for tolerance stack up in the valve train.

BACKGROUND OF THE INVENTION

For many internal combustion engine applications, such as for powering heavy trucks, it is desirable to operate the engine in a braking mode. This approach involves converting the engine into a compressor by cutting off the fuel flow and opening the exhaust valve(s) for at least one engine cylinder near the end of the compression stroke for that cylinder.

An early technique for accomplishing the braking effect is disclosed in U.S. Pat. No. 3,220,392 to Cummins (incorporated herein by reference), wherein a slave hydraulic piston located over an exhaust valve opens the exhaust valve near the end of the compression stroke of an engine piston with which the exhaust valve is associated. To place the engine into braking mode, three-way solenoids are energized which cause pressurized lubricating oil to flow through a control valve, creating a hydraulic link between a master piston and a slave piston. The master piston is displaced inward by an engine element (such as a fuel injector actuating mechanism) periodically in timed relationship with the compression stroke of the engine which in turn actuates the slave piston through hydraulic force to open the exhaust valves. The compression brake system as originally disclosed in the '392 patent has evolved in many aspects, including improvements on the control valves (see U.S. Pat. Nos. 5,386,809 to Reedy et al. and U.S. Pat. No. 4,996,957 to Meistrick) and the piston actuation assembly (see U.S. Pat. No. 4,475,500 to Bostelman). In a typical modem compression braking system the exhaust valves are normally operated during the engine's power mode by an exhaust rocker lever. To operate the engine in a braking mode, a control valve separates the braking system into a high pressure circuit and a low pressure circuit using a check valve which prevents the flow of high pressure fluid back into the low pressure supply circuit, thereby allowing the formation of a hydraulic link in the high pressure circuit.

Various problems have been discovered with conventional compression braking systems. First, an inherent time delay exists between the actuation of the three-way solenoid valve and the onset of the braking mode. This time delay is in part due to the positioning of the solenoid valve a spaced distance from the control valve creating longer than desired fluid passages and thus response time. Also long fluid passages between the master and slave pistons, that is, in the high pressure circuit, disadvantageously increase the compressed fluid volume and thus the response time. In addition, in conventional compression braking systems, the braking system is a bolt-on accessory that fits above the overhead. In such systems, in order to provide space for mounting the braking system, a spacer is positioned between the cylinder head and the valve cover which is bolted to the spacer. This arrangement adds unnecessary height, weight, and costs to the engine. Many of the above-noted problems result from viewing the braking systems as an accessory to the engine rather than as part of the engine itself.

One possible solution is to integrate components of the braking system with the rest of the engine components. One attempt at integrating parts of the compression braking system is found in U.S. Pat. No. 3,367,312 to Jonsson, which discloses an engine braking system including a rocker arm having a plunger, or slave piston, positioned in a cylinder integrally formed in one end of the rocker arm wherein the plunger can be locked in an outer position by hydraulic pressure to permit braking system operation. Jonsson also discloses a spring for biasing the plunger outward from the cylinder into continuous contact with the exhaust valve to permit the cam-actuated rocker lever to operate the exhaust valve in both the power and braking modes. In addition, a control valve is used to control the flow of pressurized fluid to the rocker arm cylinder so as to permit selective switching between braking operation and normal power operation. However, the control valve unit is positioned separately from the rocker arm assembly, resulting in unnecessarily long fluid delivery passages and a longer response time. This also leads to an unnecessarily large amount of oil that must be compressed before activation of the braking system can occur, resulting in less control over the timing of the compression braking. Furthermore, the control valve is used to control the flow of fluid to a predetermined set of cylinders in the engine thereby undesirably preventing individual engine cylinders or different groups of engine cylinders from being selectively operated in the braking mode. Moreover, the control valve is a manually operated rotary type valve requiring actuation by the driver and often resulting in unreliable and inefficient braking operation. Also, rotary valves are subject to undesirable fluid leakage between the rotary valve member and its associated cylindrical bore.

U.S. Pat. No. 3,332,405 to Haviland discloses a compression braking system wherein a control valve unit, for enabling the formation of a hydraulic link, is mounted in a cavity formed in a rocker arm that operates the exhaust valves during the braking mode. Separate cam lobes are used for normal power operation and braking operation. However, a single rocker arm is used to actuate the exhaust valves during both normal and braking modes possibly causing the braking cam lobe profile design, and therefore the braking system operation, to be at least partially dependent on, or influenced by, the design of the cam lobe used for operating the exhaust valve during normal engine operation.

U.S. Pat. No. 4,251,051 to Quenneville discloses a solenoid valve assembly having an inlet communicating with a supply of fluid, and on e or more outlet passages communicating with respective loads requiring intermittent fluid supply and a design passage. A respective ball valve is positioned b between the inlet and each outlet and spring biased t o block flow between the supply and outlet passage while opening the drain passage. An armature and pin are actuated to move the ball valve s o to connect the supply to the outlet, and close the drain passage. However, when the valve assembly in the actuated position permits supply flow to the outlet passage, it does not prevent the return flow of fluid from the outlet passage into the supply passage and therefore could not permit the formation of a hydraulic link between different pressurized circuits as required by a control valve during compression braking system operation. Also see U.S. Pat. No. 5,146,890 to Gobert, et al., which discloses a method and device for compression braking.

Consequently, there is a need for a simple, yet effective braking system which is capable of minimizing the size and weight of the associated engine while ensuring optimum operation of a the compression braking system.

It is often desirable t o combine multiple profiles on a single cam lobe, e.g. a positive power or main event exhaust valve bump or motion, a compression-release brake bump or motion, and/or an exhaust gas recirculation (EGR) bump or motion. When this is done there must be a mechanism to select which profile(s)/bump(s) are to be active. Improved operation can be obtained if the main event motion is not altered by the addition of other motions. It is also desirable to be able to switch between events part way through an event, typically after a given amount of lift. Within the rocker itself, there is no way to determine the relative motion (valve lift). The closest reference point is the rocker shaft, however, the relative motion between a rocker and a stationary shaft is very small making such control difficult. The magnitude of the relative motion is on par with the manufacturing tolerances of the components making the use of such relative motion to govern control difficult. Further if the control is by means of mating hydraulic ports in the rocker shaft and rocker arm, the sealing lands would be extremely small making leakage a problem.

An additional difficulty encountered in the design of lost motion systems is that valve assemblies typically include many individual pieces that usually have a large accumulation of tolerances. Variation and accumulation of these tolerances (tolerance stack up) must be accounted for by an adjustment. Others have tried manual adjustments which are costly, time consuming and in some cases difficult or inaccurate. Some forms of automatic adjustment cannot tolerate any intentional gaps in the system (they will eliminate these gaps). Manual adjustment mechanisms, typically screw mechanisms, are common. Automatic mechanisms often consist of a spring loaded member with a ratchet to prevent backward motion or a hydraulic plunger with a check valve. Both take up play in the system but may not be selective in their action.

OBJECTS OF THE INVENTION

It is therefore an object of the present invention to overcome the above-identified deficiencies.

It is another object of the present invention to provide a lost motion feature integrated into a rocker arm without substantially increasing the envelope size.

It is another object of the present invention to include a reset function for a rocker arm such that the main valve event provided by the rocker is not altered by the provision of auxiliary valve events such as compression-release braking and EGR events.

It is another object of the present invention to provide an assembly integrated into a rocker arm that automatically adjusts for tolerance stack up in a valve train.

It is another object of the present invention to provide a rocker arm with an integrated lost motion piston that may be used to modify a valve motion profile.

It is another object of the present invention to provide a lost motion rocker arm system with a reset feature.

It is yet another object of the present invention to provide a lost motion rocker arm system with an automatic lash adjustment assembly.

It is another object of the present invention to provide a means for controlling valve motion as a function of valve lift.

It is yet another object of the present invention to provide a means for controlling valve motion as a function of valve timing.

SUMMARY OF THE INVENTION

In response to the foregoing challenges, Applicant developed an innovative and novel, system for controlling the actuation of an internal combustion engine valve, said system comprising: means for supplying energy to an engine rocker arm; an engine rocker arm shaft including an internal hydraulic passage; an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft; a lost motion piston slidably disposed in the piston recess; an hydraulic control valve disposed in the control valve recess, said control valve being adapted to reset responsive to the combination of a second engine operating condition and the rocking movement of the rocker arm to a predetermined position; means for changing the predetermined position of the rocker arm at which control valve resetting occurs; and an hydraulic subcircuit provided in the rocker arm; said subcircuit providing selective hydraulic communication between the shaft internal passage, the control valve, and the piston recess.

Applicant also developed a system for controlling the actuation of an internal combustion engine valve, said system comprising: means for supplying energy to an engine rocker arm; an engine rocker arm shaft including an internal hydraulic passage; an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft; a lost motion piston slidably disposed in the piston recess; an hydraulic control valve disposed in the control valve recess and having an outer end extending out of said recess, said control valve being adapted to reset responsive to the combination of a second engine operating condition and the rocking movement of the rocker arm to a predetermined position; means for changing the extension of the control valve outer end out of the control valve recess; and an hydraulic subcircuit provided in the rocker arm; said subcircuit providing selective hydraulic communication between the shaft internal passage, the control valve, and the piston recess.

Applicant also developed a system for controlling the actuation of an internal combustion engine valve, said system comprising: means for supplying energy to an engine rocker arm; an engine rocker arm shaft; an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft; a lost motion piston slidably disposed in the piston recess; a control valve disposed in the control valve recess, said control valve being adapted to be selectively reset; and means for selectively resetting said control valve.

Applicant further developed a system for operating at least one exhaust valve of an engine, said engine having at least two engine operating conditions, said system comprising: means for supplying energy to operate said at least one exhaust valve during one of said at least two engine operating conditions; means for actuating said at least one exhaust valve in response to energy supplied by the energy supplying means; and means for transferring a selected amount of energy from said energy supply means to the actuating means, wherein said energy transfer means transfers a first amount of energy to said valve actuating means during a first engine operating condition to open said at least one valve a first predetermined distance, and said energy transfer means transfers a second amount of energy to said valve actuating means during a second engine operating condition to open said at least one valve a second predetermined distance, wherein said first predetermined distance is greater than said second predetermined distance.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE INVENTION

Figure 1:
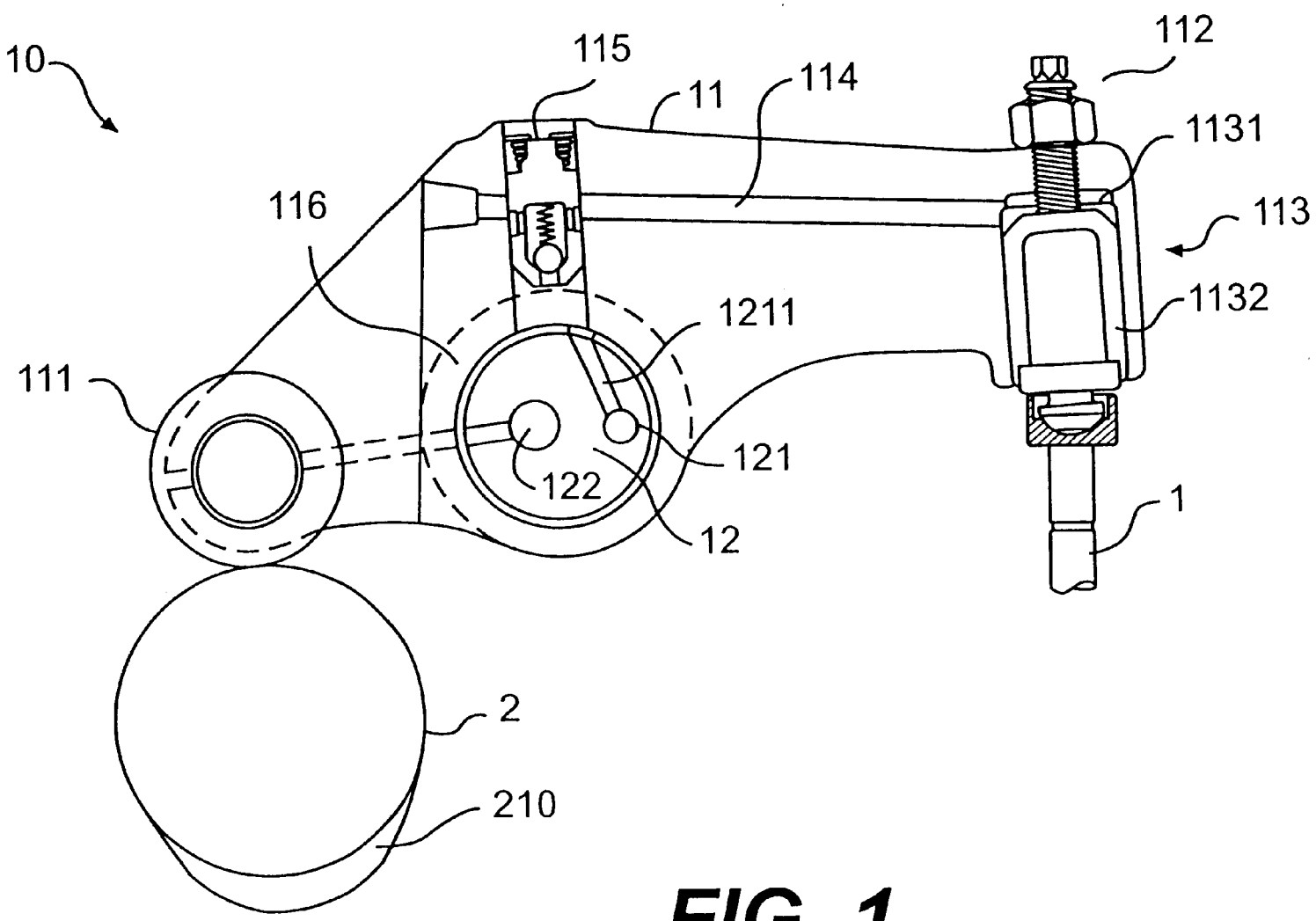
FIG. 1 illustrates a rocker arm system in accordance with an embodiment of the present invention having a manual lash adjustment assembly.

Various embodiments of the present invention are depicted in FIGS. 1–8. With reference to FIG. 1, a rocker arm system 10 for operating at least one exhaust valve 1 of an engine is shown. The engine has at least two engine operating conditions, selected from but not limited to: positive power, exhaust gas recirculation (EGR), and compression-release braking. The system 10 may include an energy supply assembly 2 for supplying energy to operate the at least one exhaust valve 1 during the at least two engine operating conditions. The present invention is described in connection with a cam assembly 2. The present invention, however, is not limited solely to the use of a cam to supply energy and/or motion to operate the engine valve 1, rather, any other suitable means, including but not limited to pistons, rods, rockers, and hydraulic fluids, are considered to be well within the scope of the energy supplying means of the present invention.

The system 10 may further include an energy transfer assembly that includes the hydraulic features such as control valve 115 etc. for selectively controlling the transfer of energy from the energy supply assembly 2 to a valve actuating assembly 11. The embodiments of the present invention are described as having a rocker arm 11 as the valve actuating assembly. The valve actuating assembly may actuate the at least one exhaust valve in response to operation of the energy transfer assembly.

During operation of the system 10, the energy transfer assembly permits transfer of a first amount of energy, using hydraulic fluid for example, to the valve actuating assembly during a first engine operating condition to open the at least one valve a first predetermined distance. The energy transfer assembly permits transfer of a second amount of energy to the valve actuating assembly during a second engine operating condition to open the at least one valve a second predetermined distance. The first engine operating condition may be positive power operation, while the second engine operating condition may be compression-release braking operation.

The present invention will now be described in connection with specific embodiments of the present invention. FIG. 1 illustrates a rocker arm system 10 in accordance with one embodiment of the present invention. The rocker arm system 10 includes a rocker arm assembly 11 pivotally mounted on a rocker shaft 12. The rocker arm assembly 11 transfers energy derived from the cam assembly 2 to operate the at least one exhaust valve 1. The rocker arm 11 is adapted to engage at least one valve 1 to operate the valve in accordance with engine operating conditions. It is contemplated that the rocker arm 11 may engage a cross head in order to operate the at least one valve 1.

The rocker shaft 12 has a passage 121 through which a supply of controlled engine oil or other suitable hydraulic fluid flows there through to the rocker arm 11 on demand. A valve assembly, not shown, controls the flow of engine oil to the rocker arm 11. It is contemplated that the valve assembly may be located on the rocker shaft 12. Alternatively, a valve assembly located on the rocker arm 11 is also considered to be within the scope of the present invention.

The rocker shaft 12 has a passage 122 through which a supply of engine oil or other suitable fluid, including but not limited to hydraulic fluid and fuel, flows there through to lubricate the rocker arm 11 to enable smooth pivotable movement of the rocker arm 11 about the rocker shaft 12.

The rocker arm 11 is located adjacent to a cam shaft 2 having at least one cam lobe 210. The cam lobe 210 includes multiple profiles on a single cam lobe to provide for valve operation during positive power, compression release braking and any other desired valve events. A profile may also be provided, for example, to permit an exhaust gas recirculation event. The rocker arm 11 transfers the profile of the at least one lobe 210 to operate the at least one valve 1.

The rocker arm 11 is rotatably mounted on the rocker shaft 12. A first end of the rocker arm 11 includes a cam lobe follower 111. The cam lobe follower 111 preferably includes a roller follower that is adapted to contact the cam lobe 210.

Any suitable follower that can interact with the energy supply assembly is considered to be well within the scope of the present invention. A second end of the rocker arm 11 has a lash adjuster 112. The lash adjuster 112 is described in detail below.

The rocker arm 11 also includes a lost motion piston assembly 113. The lost motion piston assembly 113 is located adjacent the lash adjuster 112. The lost motion piston assembly 113 includes a cavity 1131 and a piston 1132. The cavity 1131 is in communication with a fluid passageway 114 that extends through the rocker arm 11. The rocker arm 11 also includes a control valve 115. The control valve 115 is in communication with the fluid passageway 114 that extends through the rocker arm 11 to the lost motion piston assembly 113. The control valve 115 is also in communication with a fluid passageway 1211 in rocker shaft 12 that extends between the control valve 115 and passage 121 of the rocker shaft 12. The fluid passageway 1211 terminates at a control slot 116. The control valve 115 is capable of being received within the control slot 116.

As discussed above, the lash adjuster 112 is located on one end of the rocker arm 11. The lash adjuster 112 permits manual adjustment of the lash. A desired lash may be set by rotating the lash adjuster 112. An autolash may be provided instead of a manually adjusted lash, as discussed below in connection with other embodiments of the invention.

The operation of the rocker arm system 10 will now be described. During positive power, the valve assembly (not shown) associated with the passage 121 is closed. As such, hydraulic fluid does not flow from the passage 121 to the rocker arm 11. Hydraulic fluid is not provided to the lost motion piston assembly 113. The lost motion piston assembly 113 remains in the collapsed position illustrated in FIG. 1. In this position, only the main event motion associated with the main event profile on the at least one lobe 210 is transferred to the at least one valve 1.

The operation of the rocker arm system 10 during another engine operating condition, such as, for example, compression-release retarding, will now be described. During a compression-release retarding operation, the valve assembly associated with the passage 121 on the rocker shaft 12 is opened. Hydraulic fluid flows from the passage 121 in the rocker shaft 12. The presence of hydraulic fluid within fluid passageway 1211 and control slot 116 causes the control valve 115 to be biased such that hydraulic fluid flows through the passageway 114 to the lost motion piston assembly 113, causing it to extend such that all movement of the rocker arm 11 derived from the at least one lobe 210 is transferred to the at least one valve 1 through the lost motion piston assembly 113. In this arrangement, the motion and/or energy derived from auxiliary cam bumps (those other than the main event bump) is transferred to the engine valve. During compression-release retarding mode, the main event lift of the engine valve is increased by the amount of additional piston travel of the lost motion piston assembly 113. This arrangement, however, can lead to valve to piston contact or to increased engine emissions if large valve pockets are machined into the pistons to prevent valve to piston contact.

It is contemplated that in an alternative embodiment, the control valve 115 may be selectively operated and adjusted to independently vary the timing and lift of the at least one engine valve 1 by controlling the amount of hydraulic fluid that flows through the passage 114 to the lost motion piston assembly 113. In this manner the control valve 115 may provide a means for changing the resetting of the rocker arm follower 111 on the cam 2.

It is further contemplated that in an alternative embodiment, the control valve 115 may be rotated approximately 90° such that it is substantially aligned with the shaft 12. An external solenoid or other mechanical control device may be used to control the position of the control valve 115.

Figure 2:
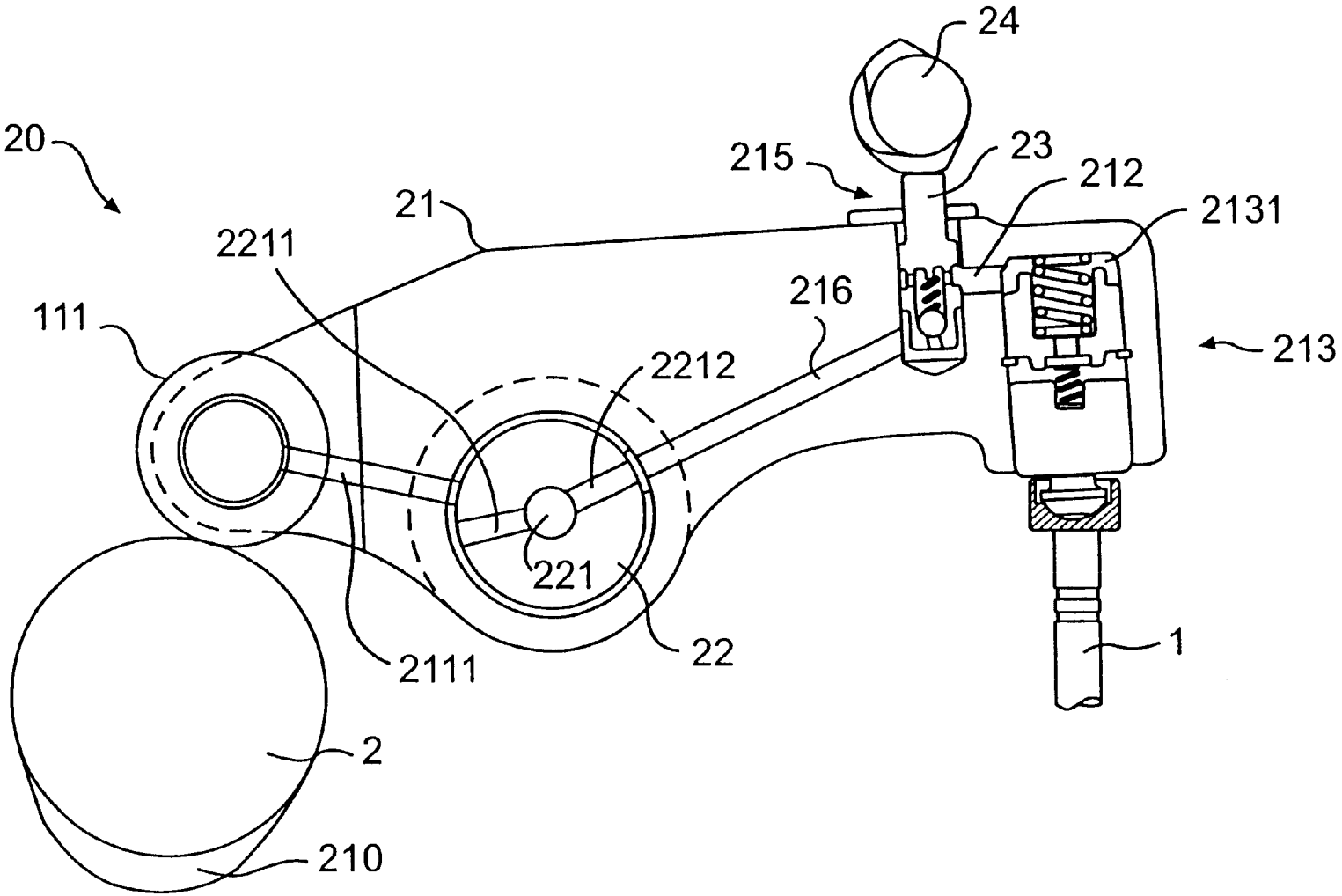
FIG. 2 illustrates a rocker arm system in accordance with another embodiment of the present invention having a reset assembly and an automatic lash adjustment assembly.

FIG. 2 illustrates a rocker arm system 20 having a rocker arm assembly 21 pivotally mounted on a rocker shaft 22. The rocker arm 21 is adapted to engage at least one engine valve 1 to operate the valve 1 in accordance with various engine operating conditions. The rocker shaft 22 has a passage 221 through which a supply of hydraulic fluid (e.g., engine oil or other suitable hydraulic fluid) is continuously supplied to the rocker arm 21. The rocker shaft 22 has a first passageway 2211 through which the hydraulic fluid flows to lubricate the rocker arm 21 and enable smooth pivotable movement of the rocker arm 21 about the rocker shaft 22. A second passageway 2212 extends from the passage 221 to provide a supply of hydraulic fluid to operate a valve actuating assembly. The hydraulic passages in the rocker arm 21 collectively comprise a hydraulic subcircuit therein.

Like the rocker arm 11, the rocker arm 21 is located adjacent to a cam shaft 12 having at least one cam lobe 210. The cam lobe 210 may include multiple profiles on a single cam lobe to provide for valve operation during positive power and compression release braking modes of operation.

The rocker arm 21 includes a control valve assembly 215. The control valve assembly 215 is located within a cavity or recess within the rocker arm 21. A contact piston 23 is provided as part of the control valve assembly 215. The contact piston 23 interacts with the fixed stop or braking mode shaft 24. A fluid passageway 216 extends from the control valve assembly 215 to the rocker arm shaft 22 such that hydraulic fluid from the second passageway 2212 flows to the control valve assembly 215. A third fluid passageway 212 extends from the control valve assembly 215 to a lost motion or autolash piston assembly 213.

Figure 5:
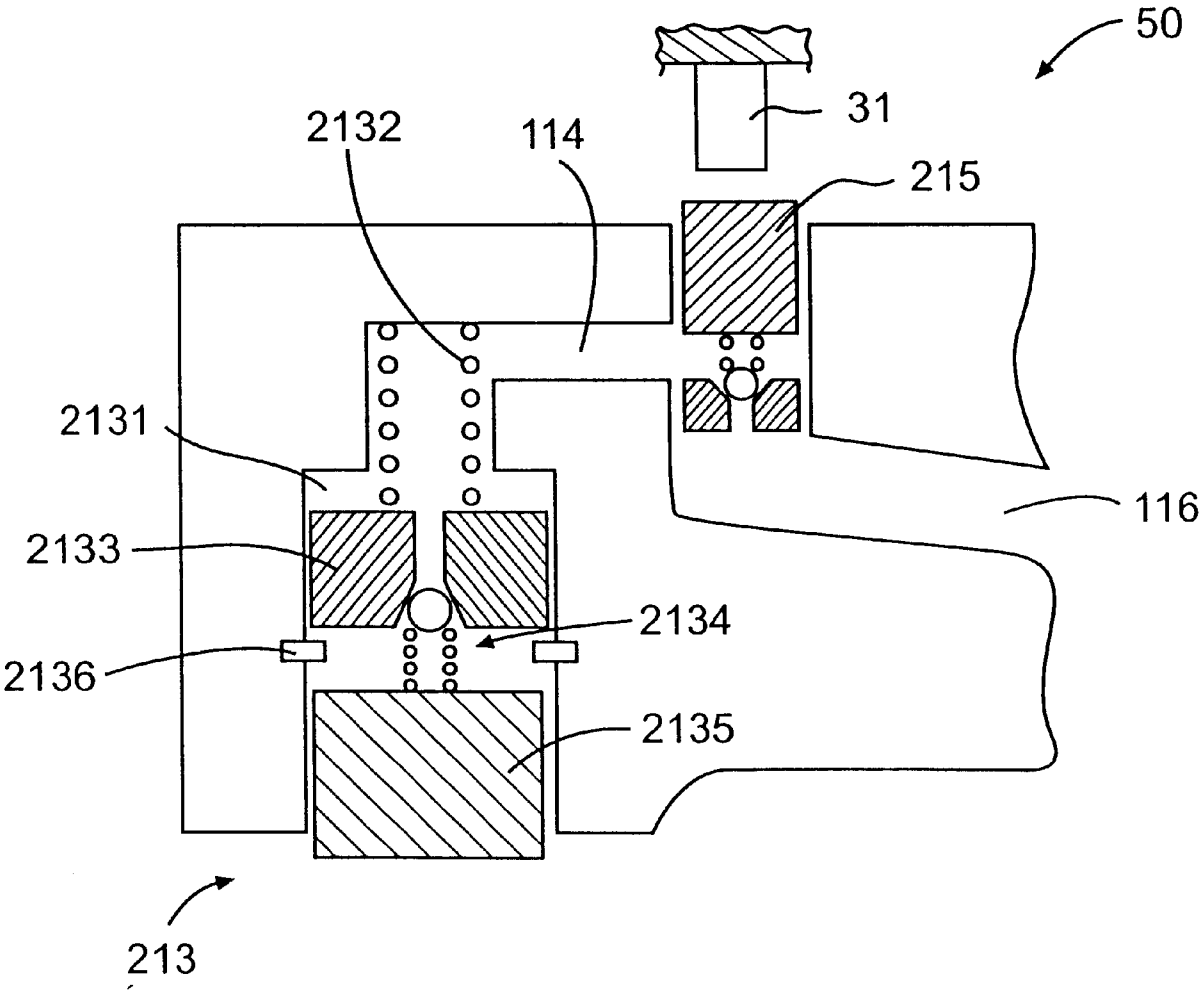
FIG. 5 illustrates a rocker arm system in accordance with another embodiment of the present invention having a reset assembly and an automatic lash adjustment assembly.

The autolash piston assembly 213 is slidably disposed in a recess 2131 provided in an end of the rocker arm 22. With reference to FIGS. 2 and 5, the autolash piston assembly 213 includes an upper spring 2132, an upper reset piston 2133, a check valve 2134, and a lower piston 2135. The check valve 2134 may incorporate a ball stop as shown in FIG. 5 or a disk stop as shown in FIG. 2. A piston recess wall feature may extend inward from the recess wall so as to limit the upward travel of the lower piston 2135 and the downward travel of the upper reset piston 2133.

When the system 20 is "off" or not in the braking mode, shaft 24 is rotated so that its lobes do not contact the contact piston 23. The control valve 215 is then in its uppermost position against the shaft 24. In this position, forward and reverse hydraulic communication is permitted between the passage 216 and the passage 212. Fluid is able to flow through the check valve 2134 within the lost motion piston assembly 213 and cause the lower piston 2135 to move down and contact the engine valve 1, removing the lash from the system. The fluid in the passage 212 may also index the upper reset piston 2133 down against the piston recess wall feature. When the roller 111 encounters a brake bump on the cam 2, the rocker arm 22 rotates downward toward the engine valve 1. At the same time, both the upper reset piston 2133 and the lower piston 2135 are displaced upward in the bore 2131 until the upper reset piston 2133 hits the end of its travel against the upper end of the bore 2131. The upper reset piston 2133 contacts the upper end of the bore 2131 at the maximum point of the brake bump which results in the entire braking motion being lost. The rocker arm 22 is then able to impart the full main event motion to the engine valve 1.

When the system 20 is in the braking mode, shaft 24 is rotated so that some number of control valves 215 are displaced downward into their "on" positions. The lobes on shaft 24 may be arranged so that varying numbers of cylinders may be placed in braking mode to regulate braking power.

When the control valve 215 is in the "on" position, reverse hydraulic communication between the passages 216 and 212 is blocked. Fluid may flow from passage 216 through the check valve portion of the control valve 215 to passage 212, however it may not flow in the reverse direction. This allows the autolash function of the lost motion piston assembly 213 to work when the brake is in the on position. When the brake bump is encountered, fluid cannot flow backward from passage 212 to passage 216, and the brake motion is imparted to the engine valve 1. As the rocker arm 22 rotates downward toward the engine valve 1, the control valve 215 remains in contact with the lobe on the shaft 24, causing relative motion between the control valve and the rocker arm. After a predetermined amount of travel, the control valve moves sufficiently upward to reestablish the reverse hydraulic connection between passages 212 and 216 allowing reset to occur. Reset travel sufficient to lose the magnitude of the brake bump is built into the stroke of the reset piston 2133. At the end of the main event when the roller 111 returns to the lower base circle of the cam lobe 210, the control valve 215 will be moved back to its "on" position by the lobe on shaft 24 and fluid will flow through the (internal) check valve to refill the reset piston 2133.

Figure 3:
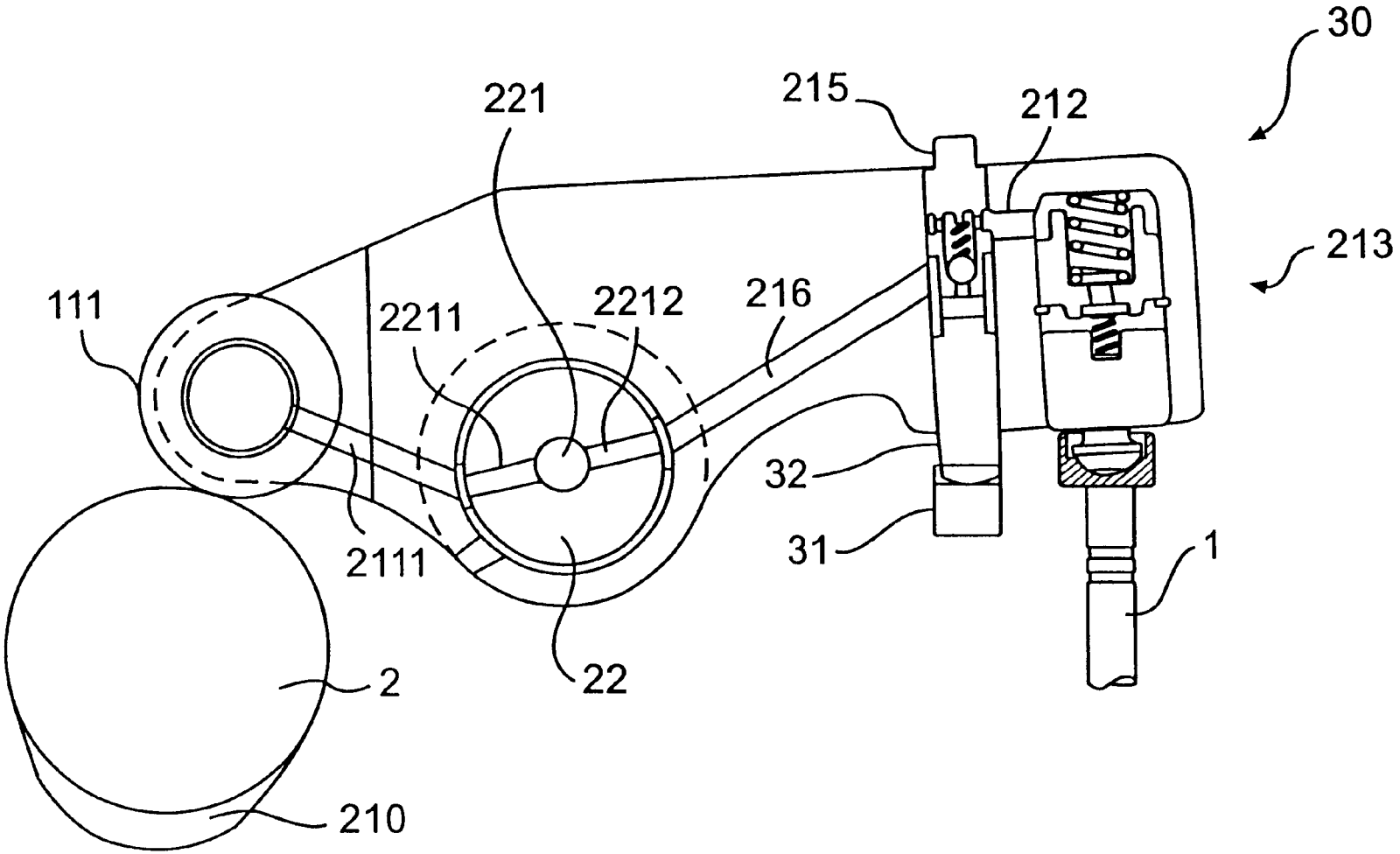
FIG. 3 illustrates a rocker arm system in accordance with another embodiment of the present invention having a reset assembly and an automatic lash adjustment assembly.

FIG. 3, in which like reference numerals refer to like elements, illustrates a rocker arm system 30 in accordance with another embodiment of the present invention. The rocker arm system 30 is a variation of the rocker arm system 20, discussed above. In the embodiment disclosed in FIG. 3, the reference point for the contact piston 23 of the control valve assembly is located below the rocker arm assembly instead of above. FIG. 3 is the same as FIG. 2 except that the rotating shaft 24 is replaced by a sliding shaft 31. Sliding shaft 31 has a series of high and low portions such that various combinations of control valves 215 can be positioned in the "on" position to regulate braking power. With this configuration the spool/control valve 215 type of valve could be replaced by a check valve that can be held off of its seat when braking is not desired.

The rocker arm system 30 operates in substantially the same manner as the rocker arm systems 10 and 20 shown in FIGS. 1 and 2. In system 30, the extension of the outer end of the contact piston 23 may varied by varying the hydraulic pressure in the hydraulic subcircuit in the rocker arm 21.

Figure 4:
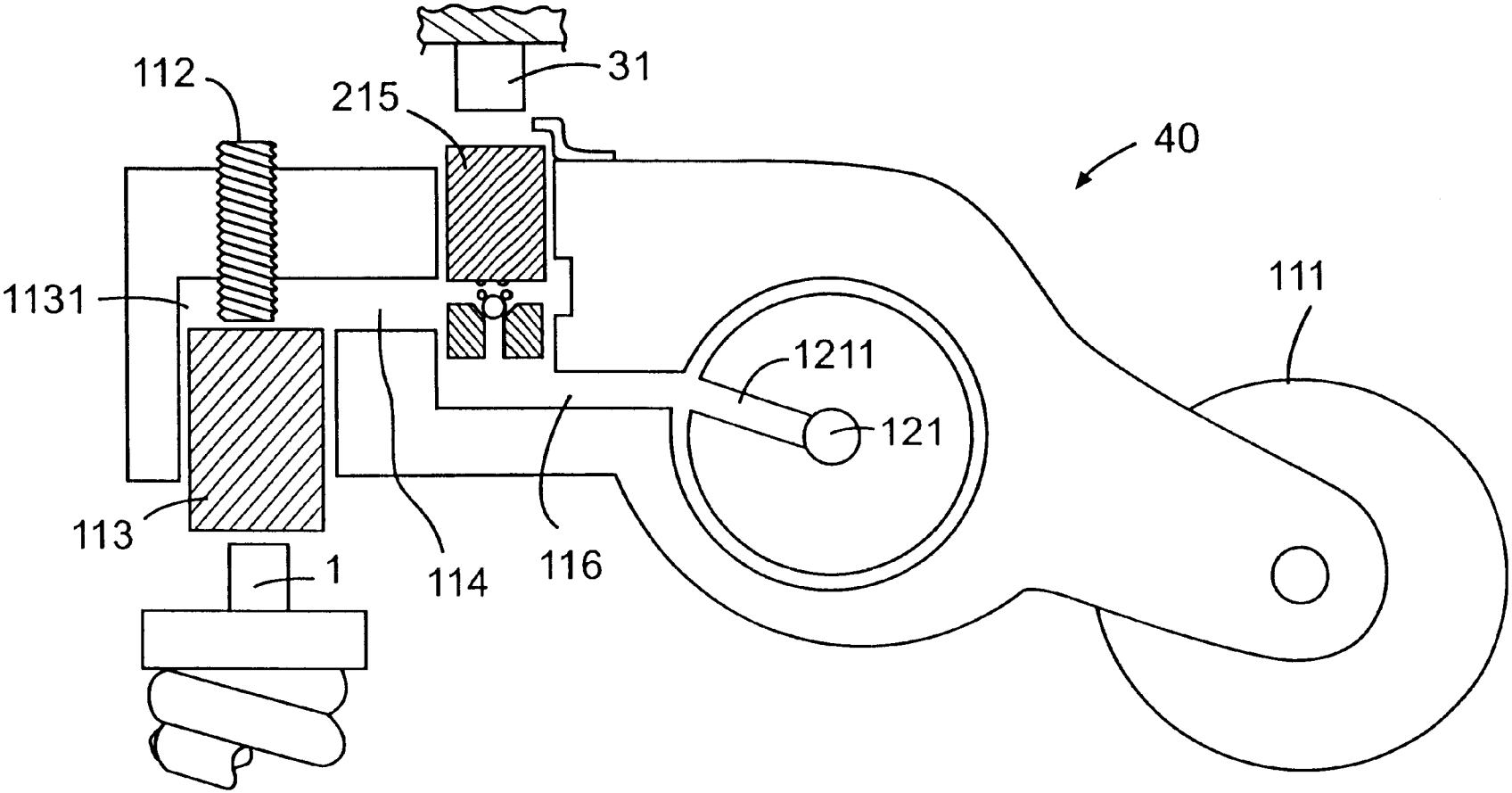
FIG. 4 illustrates a rocker arm system in accordance with another embodiment of the present invention having a reset assembly and a manual lash adjustment assembly.

FIG. 4 illustrates another variation of the present invention in which like reference numerals refer to like elements. The rocker arm system 40 includes a manual lash adjustment assembly 113, as disclosed in connection with the rocker arm system 10. The rocker arm system 40 also includes a control valve assembly 215 as disclosed in connection with the rocker arm system 20.

FIG. 5 discloses a rocker arm system 50 in accordance with another variation of the present invention having an autolash assembly 213 and a control valve assembly 215, and in which like reference numerals refer to like elements. FIG. 5 illustrates detail of the autolash lost motion piston described in connection with FIG. 2 above.

Figure 6:
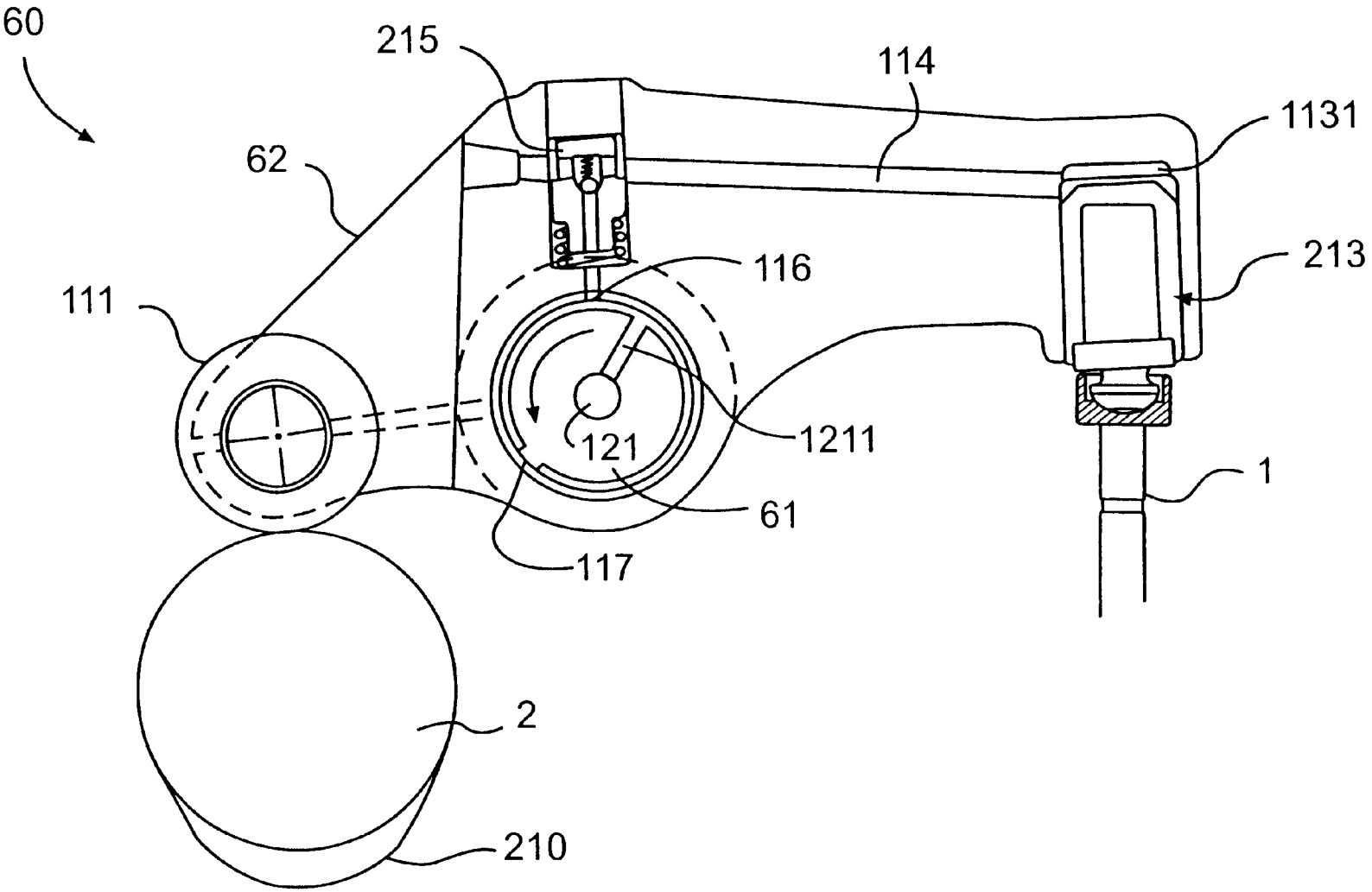
FIG. 6 illustrates a rocker arm system in accordance with another embodiment of the present invention having a rotating rocker shaft.

FIG. 6 illustrates a rocker arm system 60 in accordance with another embodiment of the present invention. In the rocker arm system 60, a port at the terminus of passage 1211 in the rotating rocker shaft 61 aligns with a port at the terminus of passage 116 in the rocker arm 62 to selectively allow or block the flow of hydraulic fluid between the rocker shaft 61 and the rocker arm 62 based on the relative angular positions of the shaft and the rocker arm. A typical rotational speed for the rocker shaft 61 may be the same as the speed of the cam assembly 2. It, however, is contemplated that other speeds may be used. For example, the rotational speed may be greater or less than the speed of the cam assembly. The timing of this alignment can be set by the phasing of the rocker shaft 61 relative to the camshaft. On and off control can be obtained by turning on and off the fluid supply or by changing the phasing of the rocker shaft 61. This permits the moving of the open or closed duration to another position (which may be inactive) on the cam profile. The rocker arm system 60 includes an autolash piston assembly 213, which is similar to the systems described above. It is also contemplated that other functions could be incorporated into the rocker arm system.

The operation of the rocker arm system 60 will now be described. When passage 1211 and passage 116 communicate, fluid can flow through the valve assembly 215 causing the piston 213 in the end of the rocker arm assembly 62 to take up any lash in the system. If a brake event is encountered when port at the terminus of passage 1211 is not covered by the land 117, the lost motion piston assembly 213 is free to reset until the reset piston 2133 reaches the end of its travel. In this manner the auxiliary cam motion may be absorbed. Any additional cam motion will be transmitted to the engine valve.

In the event that the braking event is encountered when the port at the terminus of passage 1211 is covered by the land 117, the brake motion will be conveyed to the valve 1. When the port at the terminus of passage 1211 opens, preferably at the end of the desired brake event duration, the lost motion piston assembly 213 will reset closing the engine valve.

It is contemplated that any type of valve motion (e.g., EGR and/or compression release braking) may be controlled in the above-described manner. The invention is in no way limited to the above described example. It is possible to combine several different valve motions on one cam profile and move the relative port position (phasing) to make one motion active while the other cam profile events occur when the ports are misaligned. The control valve 215 may be designed to prevent the high pressure in the lost motion piston assembly 213 from reaching the passage 1211. In the embodiment shown in FIG. 6 it is also possible to establish a hydraulic cushion to reduce wear on the rocker arm/shaft interface.

Figure 7:
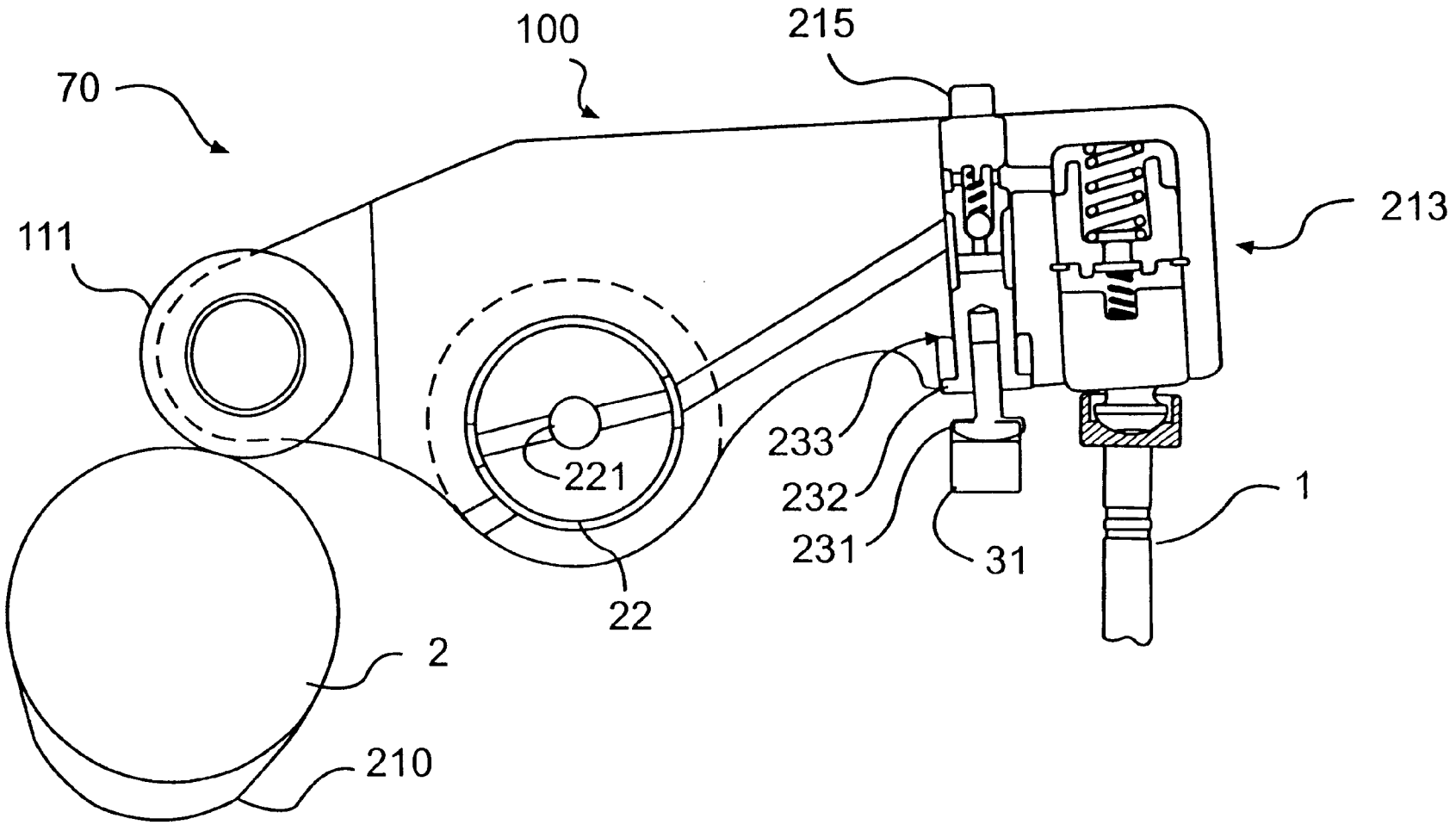
FIG. 7 illustrates a rocker arm a system in accordance with another embodiment of the present invention having as assembly for adjusting for tolerance stack up.
Figure 8:
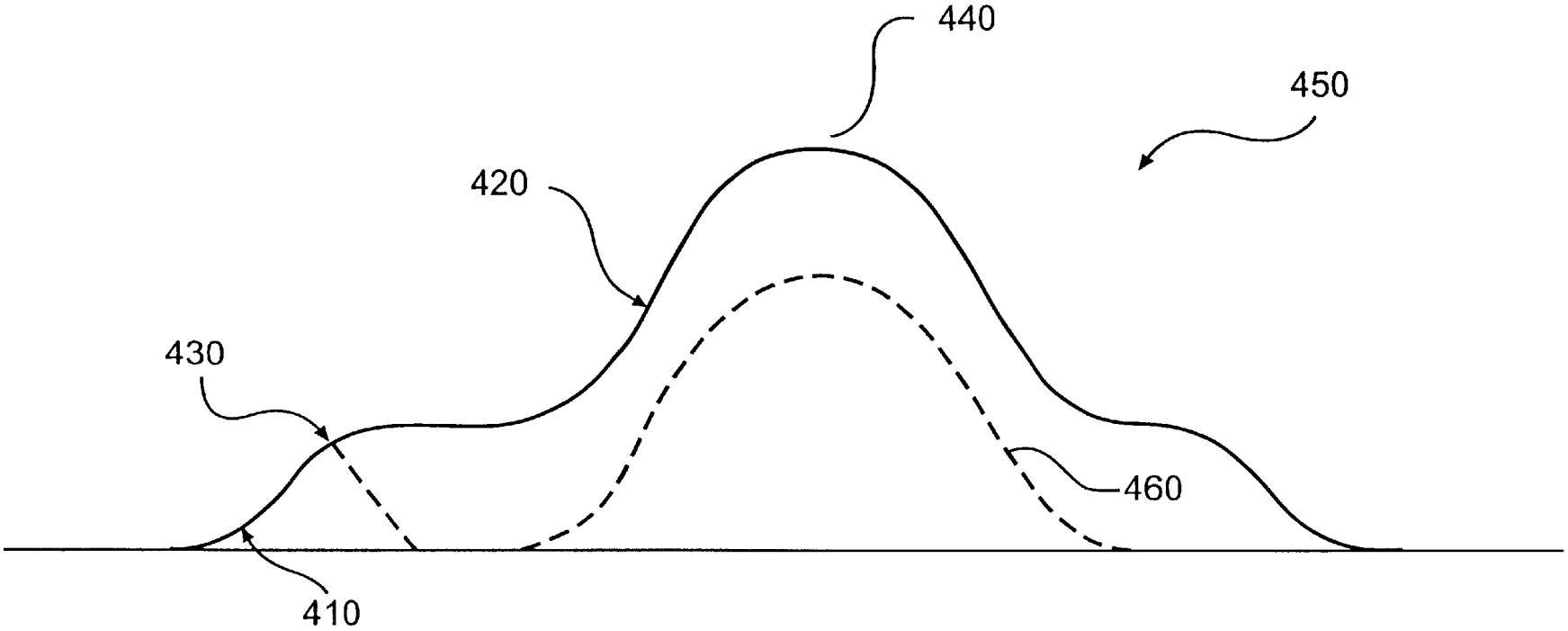
FIG. 8 is a graph illustrating cam lobe motions.

FIG. 7 illustrates a rocker arm system 70 in accordance with another alternative embodiment of the present invention. The rocker arm system 70 includes a rocker arm assembly 100 having a moveable control valve 215. The control valve 215 may be operated by a stop 31. It is contemplated that the stop 31 may be fixed or moveable, but must have a known position during the setting procedure.

The rocker arm assembly 100 is operated by a cam 2. It, however, is contemplated that other suitable means for supplying energy to the energy transfer assembly (e.g., the rocker arm) are considered to be well within the scope of the present invention. With the reference to FIG. 8, it is desired that the control valve 215 trigger the hydraulic reset of the lost motion piston assembly 213 precisely at location 430 on the cam profile 450. The main event 420 on the cam may be an intake or exhaust event. The auxiliary event 410 may be a compression-release event. The desired engine valve motion is shown by dashed line 460. Due to the individual tolerances of all of the separate pieces of the rocker arm assembly 100, there may be a large tolerance variation between stop 31 and control valve 215 when the valve train is assembled and adjusted. Control valve 215 may have an end stop pressed into one end comprised of pin 231 and a plug 232. When first assembled, the end stop projects far from the end of the control valve 215 such that the first time that rocker travels up the cam lobe and reaches location 440, the plug 232 is pushed into the lower recess 233 until it is seated against the internal shoulder in the lower recess. This sets the relative positions of the fluid metering edges machined into the control valve assembly 215 with respect to the internal passages machined into rocker assembly 100. The force required to push the plug 232 into the end of the control valve assembly 215 must be high enough to prevent accidental movement during normal operation, but low enough so that no damage occurs to the other components during this setting operation.

It is contemplated that the control valve assembly 215 also may have other functions instead of the reset function illustrated. Furthermore, the control valve assembly 215 may be positioned other than in a rocker. The control valve assembly 215 may be embodied as a mechanical trigger as opposed to a hydraulic valve in an alternative embodiment of the invention. It is also contemplated that the setting assembly described in connection with FIG. 7 may be used in any of the above-described embodiments of the invention.

It will be apparent to those skilled in the art that various modifications and variations can be made in the construction and configuration of the present invention, without departing from the scope or spirit of the invention. Several variations have been discussed in the preceding text. For example, the presence or absence, and various configurations of, a lash adjustment, clipping, or other control mechanism are contemplated. So too, are various arrangements of the lost motion piston, control valve and check valves within the rocker arm are contemplated, as well as are one or multiple rocker arms actuating one or more valves, with or without a crosshead. Moreover, the energy supplying means of the present invention may actuate the valve during only one or both of the engine operating conditions, more than one energy supplying means may be used, and/or the first and second predetermined valve motions may be varied from zero to any desired amount within the operating parameters of the engine. The exhaust valve may be controlled by a hydraulic valve, as shown, or it could be controlled by a mechanical trigger element. Others modifications and variations will be apparent to persons of ordinary skill in the art. It is intended that the present invention cover all the modifications and variations of the presently described invention, provided they come within the scope of the appended claims and their equivalents.

What is claimed is:

1. A system for controlling the actuation of an internal combustion engine valve to achieve compression-release braking or exhaust gas recirculation, said system comprising:

means for supplying energy to an engine rocker arm;

an engine rocker arm shaft including an internal hydraulic passage;

an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft;

a lost motion piston slidably disposed in the piston recess;

an hydraulic control valve disposed in the control valve recess, said control valve being adapted to reset responsive to the rocking movement of the rocker arm to a predetermined position;

means for changing the predetermined position of the rocker arm at which control valve resetting occurs; and an hydraulic subcircuit provided in the rocker arm; said subcircuit providing selective hydraulic communication between the shaft internal passage, the control valve, and the piston recess.

2. The system of claim 1 wherein said control valve is a spool valve.

3. The system of claim 1 wherein said control valve incorporates a check valve.

4. The system of claim 1 wherein said means for changing is disposed below the rocker arm.

5. The system of claim 1 wherein said means for changing is disposed above the rocker arm.

6. The system of claim 1 wherein said control valve extends entirely through the rocker arm.

7. The system of claim 1 further comprising means for automatically reducing lash between the lost motion piston and the engine valve.

8. The system of claim 7 wherein said means for automatically reducing lash is incorporated into the lost motion piston.

9. The system of claim 8 wherein said lost motion piston includes an upper member, a lower member, a first spring biasing the upper member towards the lower member, and a second spring biasing the lower member away from the upper member.

10. The system of claim 7 wherein the means for automatically reducing lash is incorporated into the control valve.

11. The system of claim 1 wherein the means for changing comprises a fixed stop located external of said rocker arm, said fixed stop having a selectively adjustable surface for engaging the control valve.

12. The system of claim 11 wherein the fixed stop is rotatable.

13. The system of claim 1 wherein the means for changing comprises means for varying a rotation speed of the rocker arm shaft.

14. The system of claim 1 wherein the rocker arm shaft includes a land adapted to selectively block the flow of hydraulic fluid from the hydraulic subcircuit.

15. The system of claim 1 further comprising means for manually adjusting the lash between the lost motion piston and the engine valve.

16. The system of claim 1 further comprising a check valve provided in the hydraulic subcircuit in a position adapted to prohibit back flow of hydraulic fluid from the control valve and the lost motion piston recess to the shaft internal hydraulic passage.

17. A system for controlling the actuation of an internal combustion engine valve to achieve compression-release braking or exhaust gas recirculation, said system comprising:

means for supplying energy to an engine rocker arm;

an engine rocker arm shaft including an internal hydraulic passage;

an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft;

a lost motion piston slidably disposed in the piston recess;

an hydraulic control valve disposed in the control valve recess and having an outer end extending out of said recess, said control valve being adapted to reset responsive to the rocking movement of the rocker arm to a predetermined position;

means for changing the extension of the control valve outer end out of the control valve recess; and an hydraulic subcircuit provided in the rocker arm; said subcircuit providing selective hydraulic communication between the shaft internal passage, the control valve, and the piston recess.

18. The system of claim 17 wherein said control valve is a spool valve.

19. The system of claim 17 wherein said control valve incorporates a check valve.

20. The system of claim 17 wherein said means for changing comprises means for controlling the hydraulic fluid pressure provided to said control valve.

21. The system of claim 17 further comprising a fixed stop located externally of said rocker arm and adapted to engage the outer end of the control valve.

22. The system of claim 21 wherein the fixed stop is located above the rocker arm.

23. The system of claim 21 wherein the fixed stop is located below the rocker arm.

24. The system of claim 21 wherein the fixed stop includes a selectively adjustable surface for engaging the control valve outer end.

25. The system of claim 24 wherein the fixed stop is rotatable.

26. The system of claim 17 further comprising means for automatically reducing lash between the lost motion piston and the engine valve.

27. The system of claim 26 wherein said means for automatically reducing lash is incorporated into the lost motion piston.

28. The system of claim 27 wherein said lost motion piston includes an upper member, a lower member, a first spring biasing the upper member towards the lower member, and a second spring biasing the lower member away from the upper member.

29. The system of claim 26 wherein the means for automatically reducing lash is incorporated into the control valve.

30. The system of claim 17 further comprising means for varying a rotation speed or phase of the rocker arm shaft.

31. The system of claim 30 wherein the rocker arm shaft includes a land adapted to selectively block the flow of hydraulic fluid from the hydraulic subcircuit.

32. The system of claim 17 further comprising means for manually adjusting the lash between the lost motion piston and the engine valve.

33. A system for controlling the actuation of an internal combustion engine valve, said system comprising:

means for supplying energy to an engine rocker arm;

an engine rocker arm shaft;

an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft;

a lost motion piston slidably disposed in the piston recess; and a control valve disposed in the control valve recess, said control valve being adapted to be selectively reset in response to interaction with an external stop.

34. The system of claim 33 further comprising a fixed stop located externally of said rocker arm and adapted to engage the control valve.

35. The system of claim 34 further comprising means for adjusting the lash between the lost motion piston and the engine valve.

36. The system of claim 35 wherein the fixed stop includes a selectively adjustable surface for engaging the control valve.

37. The system of claim 36 wherein said control valve extends out of said control valve recess, and said system further comprises means for changing the extension of the control valve out of the control valve recess.

38. The system of claim 33 further comprising means for biasing the lost motion piston relative to said piston recess.

39. The system of claim 33 wherein said energy supplying means comprises a cam having a compression-release lobe, and wherein the control valve is adapted to selectively lose all of the engine valve motion provided by the compression-release lobe on the cam.

40. The system of claim 33 wherein said energy supplying means comprises a cam having a compression-release lobe, and wherein the control valve is adapted to selectively lose a portion of the engine valve motion provided by the compression-release lobe on the cam.

41. The system of claim 33 wherein said energy supplying means comprises a cam having a main exhaust lobe, and wherein the control valve is adapted to selectively lose all or a portion of the engine valve motion provided by the main exhaust lobe on the cam.

42. The system of claim 33 wherein said energy supplying means comprises a cam having at least one lobe, and wherein the control valve is adapted to selectively lose all or a portion of the engine valve motion provided by the at least one lobe on the cam.

43. A system for actuating an engine valve, said system comprising:

a rocker arm having an integrated hydraulic system;

a lower piston and an upper reset piston assembly disposed in the rocker arm hydraulic system, said lower piston being adapted to apply actuation motion to the engine valve;

means for applying hydraulic pressure to the lower piston and upper reset piston assembly; and means for selectively resetting the upper reset piston responsive to rocker arm movement.

44. A system for controlling the actuation of an internal combustion engine valve, said system comprising:

means for supplying energy to an engine rocker arm;

an engine rocker arm shaft;

an engine rocker arm mounted on the shaft, said rocker arm having a first end in operative contact with the energy supplying means, a piston recess in a second end, and a control valve recess intermediate said first and second ends, said rocker arm being adapted to rock cyclically on said shaft;

a lost motion piston slidably disposed in the piston recess; and a control valve disposed in the control valve recess, said control valve being adapted to be selectively reset responsive to rocker arm motion.

45. The system of claim 44 further comprising a fixed stop located externally of said rocker arm and adapted to engage the control valve.

* * * * *